United States Patent [19]

Martin

[11] 4,102,659

[45] Jul. 25, 1978

[54] SEPARATION OF $H_2$, CO, AND $CH_4$ SYNTHESIS GAS WITH METHANE WASH

[75] Inventor: Jay Robert Martin, Grand Island, N.Y.

[73] Assignee: Union Carbide Corporation, New York, N.Y.

[21] Appl. No.: 730,287

[22] Filed: Oct. 6, 1976

Related U.S. Application Data

[63] Continuation-in-part of Ser. No. 692,749, Jun. 4, 1976, abandoned.

[51] Int. Cl.[2] ..... F25J 3/02

[52] U.S. Cl. ..... 62/17; 62/28; 62/26; 62/31; 55/68

[58] Field of Search ..... 62/17, 40, 21, 28, 31, 62/26; 55/68

[56] References Cited

U.S. PATENT DOCUMENTS 3,886,756 6/1975 Allam et al. ..... 62/17

*Primary Examiner*—Norman Yudkoff
*Attorney, Agent, or Firm*—Steven J. Hultquist

[57] ABSTRACT

A process for separation of a synthesis feed gas mixture containing hydrogen, carbon monoxide and methane. The feed gas mixture is countercurrently contacted with methane wash liquid in a first adsorption zone and the recovered absorber bottoms liquid is contacted with hydrogen rich vapor in a second adsorption zone to recover residual hydrogen gas as overhead. Hydrogen rich vapor is generated for the second absorption zone by vaporization of second absorption zone bottoms liquid, with the bottoms liquid recovered from the second absorption zone being fractionated to recover carbon monoxide overhead gas. The process achieves the rejection of hydrogen impurity in the second absorption and associated vaporization steps with minimum degradation of refrigeration temperature levels in the process and high recovery of carbon monoxide product.

28 Claims, 6 Drawing Figures

SEPARATION OF $H_2$, CO, and $CH_4$ SYNTHESIS GAS WITH METHANE GAS

CROSS-REFERENCE TO RELATED APPLICATION

This is a continuation-in-part of U.S. application Ser. No. 692,749 filed June 4, 1976, now abandoned.

BACKGROUND OF THE INVENTION

1. Field of this Invention

This invention relates to a process for the separation of a gas mixture containing hydrogen, carbon monoxide and methane to obtain product streams of substantially pure hydrogen and carbon monoxide.

2. Description of the Prior Art

The prior art has commonly employed cryogenic processes for the separation of synthesis gas to yield hydrogen and carbon monoxide as recovered products. Such processes typically involve at least a partial liquifaction of the feed gas mixture and require the efficient use of vapor-liquid contacting and separation equipment for overall economic operation.

When manufactured for the production of carbon monoxide by primary steam reforming of natural gas or by partial oxidation of higher hydrocarbon fossil fuels, the synthesis gas mixture contains residual methane as well as the hydrogen and carbon monoxide common to all synthesis gas streams. The cryogenic processes employed for the separation of such synthesis gas mixtures are designed to reject methane and produce carbon monoxide and hydrogen at a purity consistent with the end use requirement. These designs are intended to minimize the carbon monoxide content of the rejected hydrogen and methane streams in order to maximize carbon monoxide recovery. Characteristically the gas mixture will contain approximately 50 to 70 mol % hydrogen, 15 to 45 mol % carbon monoxide and 2 to 6 mol % methane, together with minor impurities, as for example trace amounts of nitrogen.

Since essentially three primary components are present in the above-described synthesis gas mixture—hydrogen, carbon monoxide and methane—the prior art has commonly employed two serial multiple-plate column liquid-vapor contactors to carry out the synthesis gas separation. In one conventional process arrangement employing such liquid-vapor contactors, the synthesis gas feed stream is provided at elevated pressure and cooled by heat exchange to form a vapor-liquid mixture which is introduced to the first contacting column. In the first column, the introduced feed is contacted with a chilled methane wash liquid for absorption of the carbon monoxide in the methane wash liquid. Hydrogen is obtained from the first column as carbon monoxide-free overhead product and bottoms liquid is recovered comprising methane and the absorbed carbon monoxide. The recovered bottoms liquid is then throttled to reduced pressure and fractionated in the second contacting column. From the second column, carbon monoxide is recovered as overhead and methane is recovered as bottoms. The methane bottoms are chilled and recycled as the aforementioned methane wash liquid for the first contacting column.

Although the above separation system entails a comparatively simple apparatus arrangement, the carbon monoxide product recovered by the process is unsatisfactory for use in most chemical synthesis applications by virtue of its relatively high hydrogen content. Accordingly, the prior art has attempted to obtain improvement in purity of the carbon monoxide product by removal of the hydrogen contaminant upstream of the second contacting column. In one such improvement scheme, the synthesis gas is cooled by heat exchange, as before, and introduced as a vapor to the first contacting column. The bottoms liquid from the first contacting column is throttled to lower pressure and passed to a flash drum for vapor-liquid separation. In the flash drum an equilibrium vapor-liquid separation is achieved to reject the bulk of the hydrogen which would otherwise be contained in the feed to the second contacting column. The liquid from the flash drum thus freed from the hydrogen contaminant is then throttled to still lower pressure prior to its introduction to the second contacting column.

By the above-described improvement modifications, a carbon monoxide overhead product from the second contacting column can be obtained with hydrogen contaminant concentrations of less than 5000 parts per million (p.p.m.). Nonetheless the product recovery attainable in such modified systems is extremely sensitive to product purity. As a result high losses are encountered in the provision of product carbon monoxide containing hydrogen contaminant at concentration levels of less than 5000 p.p.m. Such losses occur by flash-off of carbon monoxide with the hydrogen in the equilibrium flash drum and consequent removal of the flashed carbon monoxide with the hydrogen withdrawn from the drum. Inasmuch as end use specifications for the carbon monoxide product in many applications, as for example for acrylic and polyurethane resin production, require a hydrogen content of less than about 3000 p.p.m., it has been necessary to operate the prior art process with comparatively low recovery levels, with a maximum recovery of about 90%, as based on the content of carbon monoxide in the synthesis gas feed mixture, to meet such end use carbon monoxide product specifications.

In the prior art, the refrigeration content of the reduced pressure, low temperature product streams has been utilized to cool the synthesis gas feed mixture prior to its introduction to the absorber column. Nonetheless, refrigeration is generally required to provide reflux for the second contacting column and to cool the feed gas mixture and the methane wash liquid for the first contacting column. Under such conditions, the minimum pressure at which the final contacting column can be economically operated is about 20 psia. Such minimum pressure constraint is imposed by the requirement of providing sufficient pressure to overcome the flow resistance associated with the product transfer lines. Since the process involves two substantial reductions in main stream pressure in the aforementioned throttling steps, considerable compression energy must be expended in initial pressurization of the synthesis gas feed mixture for the process.

Accordingly, it is an object of the present invention to provide an improved process for the separation of a synthesis gas mixture containing hydrogen, carbon monoxide and methane to provide a high purity (carbon monoxide-free) hydrogen product and a high purity (hydrogen-free) carbon monoxide product.

It is another object of the invention to provide an improved process of the above type wherein high recovery of carbon monoxide is achieved.

It is still another object of the invention to provide an improved process of the above type characterized by low process energy requirements.

Other objects and advantages of the invention will be apparent from the ensuing disclosure and appended claims.

SUMMARY OF THE INVENTION

This invention relates to a process for the separation of a feed gas mixture containing hydrogen, carbon monoxide and methane.

In the process of the invention, the feed gas mixture containing hydrogen, carbon monoxide and methane is cooled and countercurrently contacted with a methane wash liquid is a first absorption zone to recover hydrogen gas as overhead and bottoms liquid comprising methane, carbon monoxide and residual hydrogen. The bottoms liquid from the first absorption zone is throttled to lower pressure, and countercurrently contacted with hydrogen rich vapor in a second absorption zone for absorption of carbon monoxide from the hydrogen rich vapor by the throttled bottoms liquid therein to recover residual hydrogen gas as overhead and bottoms liquid enriched in carbon monoxide. Second absorption zone bottoms liquid is warmed to vaporize a gaseous fraction therefrom containing hydrogen and carbon monoxide, as the hydrogen rich vapor for the second absorption zone. The warmed bottoms liquid recovered from the second absorption zone is fractionated in a fractionation zone to recover overhead gas comprising carbon monoxide and bottoms liquid comprising methane. At least part of the bottoms liquid recovered from the fractionation zone is recirculated to the first absorption zone as the methane wash liquid therefor.

In a preferred embodiment of this invention, the warming of second absorption zone bottoms liquid is performed externally of the absorption zone, with separation of the resulting vaporized gaseous fraction from the warmed bottoms liquid and passage of the former to the second absorption zone as the hydrogen rich vapor therefor. In this embodiment the warming is preferably conducted by countercurrent heat exchange so as to maintain a temperature gradient in the fluid being warmed from the initial part of the warming to the final part thereof. Alternatively, the warming of second absorption zone bottoms liquid may be carried out internally in the zone by indirect heat exchange with an appropriate intra-process stream, such as the feed gas mixture. This heat exchange may be carried out for example, by flow of the process stream heating fluid through an internally disposed reboil heating coil positioned in the lower section of the second absorption zone.

In another preferred embodiment under the above process, the carbon monoxide overhead gas recovered from the fractionation zone is employed as refrigeration fluid for the process. The overhead gas recovered from the fractionation zone is divided into two portions comprising a first portion and a second portion. The second portion is heat exchanged for warming thereof with the feed gas mixture as at least part of the aforementioned cooling of the latter. This heat exchanged overhead gas second portion is compressed to higher pressure and a part thereof is withdrawn as carbon monoxide product gas. The remaining part of the compressed overhead gas portion is cooled and divided into a minor portion for isentropic expansion and a major refrigeration fluid portion. The minor portion is isentropically expanded and joined with the first portion of the overhead gas recovered from the fractionation zone to form a recycle minor part gas. The recycle minor part gas is warmed and joined with the heat exchanged overhead gas second portion for compression therewith. The major refrigeration fluid portion is divided into two parts. One part is cooled for condensation thereof to form cooled liquid by heat exchange with fractionation zone bottoms liquid for vaporization of the latter to provide reboil vapor for the fractionation zone. The cooled liquid one part is then subcooled by heat exchange with the recycle minor part gas for the aforementioned warming of the latter. The other part of the major refrigeration fluid portion is throttled to low pressure and the subcooled liquid one part is joined with the throttled other part to form a refrigeration gas-liquid mixture. The refrigeration gas-liquid mixture is throttled to lower pressure and warmed to form a first gaseous fraction and a first liquid fraction therefrom by heat exchange with a portion of the bottoms liquid recovered from the fractionation zone being recirculated to the first absorption zone as the methane wash liquid therefor. In this heat exchange, the fractionation zone bottoms liquid portion is subcooled. The first gaseous fraction of the refrigeration gas-liquid mixture is separated from the first liquid fraction thereof. The separated first liquid fraction of the refrigeration gas-liquid mixture is then throttled to still lower pressure and warmed to form a second gaseous fraction and a second liquid fraction therefrom. This warming is effected by heat exchange with the feed gas mixture as at least part of the aforementioned cooling thereof. The second gaseous fraction of the refrigeration gas-liquid mixture first liquid fraction is separated from the second liquid fraction thereof and the latter is then heat exchanged with fractionation zone overhead to provide reflux cooling for the fractionation zone. The second gaseous fraction and the first gaseous fraction are joined with the recycle minor part gas.

As used herein, the term "recover" or "recovered" will be understood to relate to an overhead or bottoms fluid which is withdrawn from a given separation zone subsequent to any respective reflux condensing or reboil vaporizing operations associated therewith. The terms "gas" and "gaseous" will be understood to refer to both gases and vapors.

As described above, the vaporization warming of the second absorption zone bottoms liquid in a preferred embodiment of this invention is conducted by countercurrent heat exchange so as to maintain a temperature gradient in the fluid being warmed from the initial part of the warming to the final part thereof. This is intended to mean that the bottoms liquid and resulting formed vapor are passed along a flow path, as through a passage of a heat exchanger, and that heat is transferred to the liquid/vapor fluid along the flow path so as to progressively partially vaporize the liquid to form vapor. Thus at the terminal part of the flow path, the two-phase fluid comprising liquid and vapor will be at a higher temperature than the bottoms liquid introduced at the inlet part of the flow path and a temperature gradient will exist along the flow path, from the inlet part of the flow path, corresponding to the initial part of the warming, to the terminal part of the flow path, corresponding to the final part of the warming. Such vaporization warming by countercurrent heat exchange relative to vaporization warming by an internally disposed reboiling coil, permits substantially higher recovery of the refrigeration content of the second absorption zone bottoms liquid to be achieved. This improvement is due to the fact that the fluid giving up heat to the bottoms liquid can be cooled to a temperature which is substantially less than the temperature of the fully warmed second absorption zone bottoms liquid, at the final part of the warming step. In other words, such vaporization warming heat exchange permits cooling of the fluid giving up heat to the second absorption zone bottoms liquid to a close temperature approach to the temperature of the bottoms liquid withdrawn from the second absorption zone, at the initial part of the warming step.

In the foregoing description of the process of the present invention, it will be understood that the initial cooling of the feed gas mixture is intended to be broadly construed to include internal cooling of the feed gas mixture in the absorption zone, as for example by intercooling between the tray or plate members of an absorber column, as well as feed gas cooling which is performed external to the absorption zone. It will also be understood that the step of heat exchange with fractionation zone overhead to provide reflux cooling for the fractionation zone, as referred to earlier herein, is intended to be broadly construed to include heat exchanges such as involve passage of a cooling fluid in indirect heat exchange relationship with fractionation zone overhead, as for example by flow of the cooling fluid and overhead streams through adjacent passages in a heat exchanger or by flow of the cooling fluid through a reflux condensing coil disposed internally in the fractionation zone, as well as to include reflux cooling heat exchange involving direct introduction of cooling fluid to the fractionation zone as reflux liquid.

The present invention is based on the discovery that a second absorption zone may be interposed between absorption and fractionation zones, in a process for separating a feed gas mixture containing hydrogen, carbon monoxide and methane, and utilized to remove residual hydrogen from the bottoms liquid recovered from the first absorption zone, to achieve a substantial and unexpected improvement in recovery of high purity (i.e., less than 20,000 p.p.m. hydrogen contaminant) carbon monoxide relative to the processes heretofore used for such separation. Although the prior art has employed equilibrium flash separation steps between the absorption and fractionation zones for the same purpose — i.e., to remove residual hydrogen from the bottoms liquid recovered from the absorption zone — it has been found that absorption contacting of the recovered first absorption zone bottoms liquid with hydrogen rich vapor obtained by vaporization of the second absorption zone bottoms liquid in accordance with the process of this invention, results in a significantly smaller loss of carbon monoxide in the residual hydrogen gas recovered in the intermediate step. Accordingly, whereas the prior art utilizing equilibrium flash separation is able to realize a maximum carbon monoxide recovery of for example only about 89% to produce a carbon monoxide product containing 3000 p.p.m. hydrogen contaminant at a fractionation zone operating pressure of about 20 psia, the process of the present invention under the same conditions of product carbon monoxide purity and fractionation zone operating pressure is able to achieve carbon monoxide recovery levels on the order of 97%. As used herein, the term carbon monoxide recovery is based on the amount of carbon monoxide in the feed gas mixture introduced to the process which is obtained in the overhead gas recovered from the fractionation zone.

The relatively low recovery of product carbon monoxide in the prior art systems utilizing equilibrium flash separation is a consequence of the high concentration of carbon monoxide in the vapor from the flash separation step. In view of such deficiency of the equilibrium flash separation system, one of ordinary skill might logically conclude that product carbon monoxide recovery for the process could be substantially improved by replacement of the equilibrium flash separation equipment with a multiple stage enriching zone wherein overhead vapor is at least partially condensed, inasmuch as carbon monoxide, being the least volatile component of the vapor, would thereby be minimized in the overhead gas recovered from this intermediate step. Surprisingly, however, it has been found that product carbon monoxide recovery can be materially improved by utilizing a multiple stage zone in the intermediate step which does not employ such overhead vapor condensing feature. Thus, under this invention, the use of a second absorption zone in the intermediate process step, wherein the bottoms liquid recovered from the first absorption zone is countercurrently contacted with hydrogen rich vapor, has unexpectedly been found to yield a rejected hydrogen overhead gas which contains substantially less carbon monoxide than the vapor from the prior art equilibrium flash separator, thereby permitting correspondingly greater recovery of carbon monoxide as product to be achieved. Such increase in carbon monoxide recovery in turn significantly enhances the economy of the separation process of this invention relative to the processes of the prior art.

Although the implementation of a second absorption zone and second absorption zone bottoms liquid warming step in the gas separation process under the present invention, in addition to the conventional (first) absorption and fractionation zone components, involves an additional heat input for the second absorption zone bottoms liquid vaporization warming step, it has been discovered that such heat can conveniently be supplied by heat exchange involving an appropriate intra-process stream. As used in this context, the term intra-process stream includes streams derived in the process from the feed gas mixture, as for example the bottoms liquid recovered from the fractionation zone, as well as the feed gas mixture itself and also includes externally supplied refrigeration fluid which is circulated in a closed loop refrigeration circuit in the process system. By means of such intra-process heat exchange, it is possible to minimize the energy input required for process refrigeration.

In accordance with the foregoing, the absorption zones in the process of this invention each comprise a multiplicity of liquid-vapor contacting stages serially joined in liquid and vapor flow communication with one another, to allow descending liquid to be sequentially contacted with ascending vapor for heat and mass exchange therewith as the liquid and vapor phases pass through the absorption zone. In practice, the number of such contacting stages is determined by calculation of the number of theoretical equilibrium stages, i.e., stages wherein the phases leaving the stage are in thermodynamic equilibrium, and conversion of the number of theoretical equilibrium stages to an actual number of stages, as based on stage efficiencies of the actual stages. Such calculational procedure is generally applied to the design of heat and mass transfer operations and is well-known to those skilled in the art. In the present invention, the second absorption zone comprises at least two theoretical equilibrium stages and preferably between two and five theoretical equilibrium stages. In actual practice, the first and second absorption zones may suitably be provided as a multi-tray or packed columns of conventional type.

The fractionation zone in the present invention may also be provided as a multi-tray or packed column of conventional type, together with associated apparatus for providing reboil vapor and reflux liquid to the column. The fractionation zone differs from the absorption zone in the present invention in that reflux liquid is provided to the fractionation zone in the upper section thereof by heat pumping between the reboiler and the upper section whereas no such heat pumping step is associated with the absorption zones.

DESCRIPTION OF THE PREFERRED EMBODIMENTS

Figure 1:
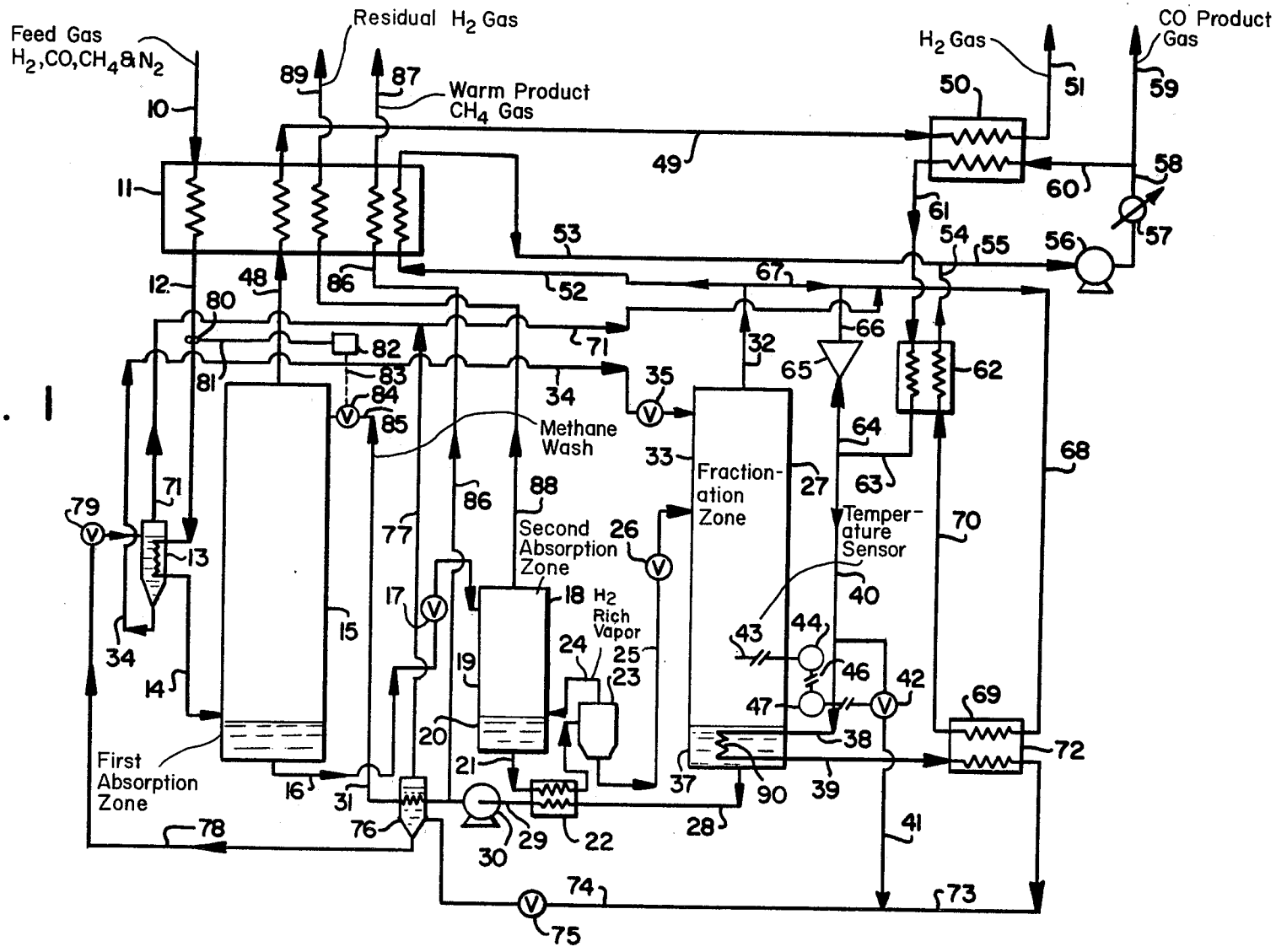
FIG. 1 is a schematic flowsheet of a separation process according to one embodiment of the invention, in which carbon monoxide overhead gas recovered from the fractionation zone is employed as refrigeration fluid for the process.

Referring now to the drawings, FIG. 1 is a schematic flowsheet of one embodiment of the present invention. The following description of the FIG. 1 process will be based on a feed gas mixture introduced at a flow rate of 2235 lb. moles/hr. into the process system in line 10 at a pressure of 210 psia and a temperature of 283° K (10° C), having the following molar composition: hydrogen = 79.8%, nitrogen = 0.2%, carbon monoxide = 15.8% and methane = 4.2%.

In the process of the present invention, the feed gas may suitably have a pressure of at least 100 psia in order to provide sufficient pressure to accommodate the subsequent process throttling steps while maintaining pressure levels of at least 20 psia and at least 15 psia in the second absorption and fractionation zones, respectively. A pressure level of at least 20 psia in the second absorption zone and bottoms liquid partial vaporiation step is desired to minimize the presence of carbon monoxide contaminant in the residual hydrogen gas recovered as overhead from the second absorption zone, while a pressure level of at least 15 psia is desired in the fractionation zone to overcome the pressure drop associated with the product transfer lines joined thereto and to insure efficient separation between the carbon monoxide and methane components therein.

The feed gas mixture entering in line 10 is partially cooled in heat exchanger 11 by heat exchange with other process streams flowed therethrough and is discharged into line 12. The partially cooled feed gas mixture is then further partially cooled to 87.6° K in heat exchanger 13 by the process refrigeration fluid to provide cooled feed gas mixture which is introduced in line 14 to the lower section of the first absorption zone 15, which may suitably comprise a multi-tray column of conventional design.

In the first absorption zone 15, the cooled feed gas mixture is countercurrently contacted with a methane wash liquid introduced to the upper section of the absorption zone in line 85, to recover hydrogen gas as overhead in line 48 and bottoms liquid comprising methane, carbon monoxide and residual hydrogen in line 16. The overhead hydrogen gas is withdrawn from the absorption zone in line 48 at a flow rate of 1780 lb. moles/hr., a pressure of 210 psia, and a temperature of 92.5° K, containing 98.6 mol % hydrogen, p.4 mol % methane, 434 p.p.m. nitrogen and 7.0 p.p.m. carbon monoxide. From line 48 the recovered overhead hydrogen gas is flowed through the heat exchanger 11 for partial warming thereof by heat exchange with the feed gas mixture from line 10, as part of the aforementioned partial cooling of the latter. The partially warmed overhead hydrogen gas is discharged from heat exchanger 11 in line 49 and passed to heat exchanger 50 for further warming therein to about ambient temperature and subsequent removal from the process as warm hydrogen gas in line 51.

The bottoms liquid is recovered from the first absorption zone in line 16 at a flow rate of 2574 lb. moles/hr. and temperature of 97.7° K, containing 85.0 mol % methane, 13.7 mol % carbon monoxide, 1.1 mol % hydrogen and 0.2 mol % nitrogen. This bottoms liquid is throttled in throttle valve 17 to a pressure of 42 psia and introduced to the upper section 18 of second absorption zone 19.

In the second absorption zone, the throttled first absorption zone bottoms liquid is countercurrently contacted with hydrogen rich vapor at a liquid to vapor molar flow ratio of at least 10, as for example 20, for absorption of carbon monoxide from the hydrogen rich vapor by the throttled bottoms liquid therein to recover residual hydrogen gas as overhead and bottoms liquid enriched in carbon monoxide. The liquid collecting in the bottom section 20 of the stripping zone is withdrawn therefrom in line 21 for recovery of bottoms liquid and is partially vaporized in heat exchanger 22, with the heat exchange thus being conducted so as to maintain a temperature gradient in the warming fluid across the heat exchanger 22. The partially vaporized liquid from heat exchanger 22 is passed to vapor-liquid phase separator 23, from which the separated gaseous fraction is recirculated to the second absorption zone in line 24 as the hydrogen rich vapor therefor. The residual hydrogen gas obtained from the second absorption zone is withdrawn in line 88 as recovered overhead at a flow rate of 44.3 lb. moles/hr., a pressure of 42 psia, a temperature of 97.7° K and a molar composition of 60.7% hydrogen, 30.7% carbon monoxide and 8.6% methane. This recovered overhead gas is conveyed in line 88 to heat exchanger 11, wherein the overhead gas is warmed by heat exchange with the feed gas mixture, as part of the partial cooling of the feed gas mixute therein. After warming the overhead gas recovered from the second absorption zone is discharged from the process in line 89 and may for example be used as a fuel gas having a moderately high BTU heating valve.

The warmed bottoms liquid separated in phase separator 23 is withdrawn therefrom in line 25 as second absorption zone recovered bottoms liquid at a flow rate of 2530 lb. moles/hr., a temperature of 104° K and a molar composition of 86.4% methane, 13.4% carbon monoxide, 0.2% nitrogen and 257 p.p.m. hydrogen. This recovered bottoms liquid is flowed through line 25, throttled in throttle valve 26 to a pressure of 21 psia, and introduced at an intermediate point to fractionation zone 27.

In the fractionation zone 27, the bottoms liquid recovered from the second absorption zone is fractionated to recover overhead gas in line 32 and bottoms liquid in line 28. The overhead gas is withdrawn from the fractionation zone in line 32 at a flow rate of 701 lb. moles/hr., a pressure of 21 psia, a temperature of 85.2° K and a molar composition of 98.5% carbon monoxide, 1.1% nitrogen, 0.3% methane and 928 p.p.m. hydrogen. Bottoms liquid is withdrawn from the fractionation zone in line 28 at a flow rate of 2185 lb. moles/hr., a pressure of 23 psia, a temperature of 85.2° K and a composition of substantially pure methane, containing only 15 p.p.m. carbon monoxide.

Reflux for the fractionation zone is provided by direct introduction of carbon monoxide liquid to the top of the fractionation zone from line 34. Reboil vapor for the fractionation zone is provided by partial vaporization of the collected bottoms liquid in the lower end 37 thereof, by heat exchange with the process refrigeration fluid flowed through reboil coil 90 from line 38. The reflux and reboil operations associated with the fractionation zone will be more fully discussed hereinbelow in connection with the description of the refrigeration circuit for this embodiment of the invention.

The bottoms liquid recovered from the fractionation zone in line 28 is passed to heat exchanger 22 and heat exchanged therein with the bottoms liquid withdrawn from the second absorption zone being flowed therethrough from line 21, for the above-described partial vaporization of the latter and cooling of the fractionation zone bottoms liquid. The so-cooled fractionation zone bottoms liquid is discharged from heat exchanger 22 in line 29, pumped to higher pressure in pump 30 and split, with a portion thereof being subcooled in heat exchanger 76, as described more fully hereinafter. The subcooled portion is discharged from heat exchanger 76 into line 31. From line 31 the subcooled liquid stream is passed to the absorption zone 15 in line 85 as recirculated methane wash liquid therefor. The remaining portion of the cooled pumped fractionation zone bottoms liquid is passed in line 86 to heat exchanger 11. In heat exchanger 11, the remaining portion is warmed and vaporized to form product methane gas by heat exchange with the feed gas mixture flowing through heat exchanger 11 from line 10, as part of the cooling of the feed gas mixture. Warm product methane gas is discharged from the process in line 87.

In the FIG. 1 embodiment of the invention, carbon monoxide overhead gas recovered from the fractionation zone is employed as refrigeration fluid for the process. The overhead gas recovered from the fractionation zone in line 32 is divided into two portions comprising a first portion and a second portion. The second portion is flowed in line 52 to heat exchanger 11 in which it is warmed by heat exchange with the feed gas mixture as part of the aforementioned cooling of the latter. The heat exchanged second portion is discharged into line 53 and joined with warmed recycle minor part gas from line 54 and the combined gas stream flows in line 55 to compressor 56. The combined gas stream is compressed to higher pressure in compressor 56 and discharged to line 58. In line 58, the compressed gas is cooled by water chiller 57. A portion of the compressed and chilled gas is withdrawn in line 59 as carbon monoxide product gas, at a flow rate of 345 lb. mole/hr., a pressure of 120 psia, a temperature of 312° K and a molar composition of 98.3% carbon monoxide, 1.4% nitrogen, 0.1% methane and 1900 p.p.m. hydrogen. The remaining part of the compressed and chilled gas is diverted into line 60 and is partially cooled in heat exchanger 50 by heat exchange with the product hydrogen gas flowing therethrough. From heat exchanger 50 the remaining part of the compressed and chilled gas is flowed through line 61 and additionally cooled in heat exchanger 62 by heat exchange with the recycle minor part gas flowed therethrough from line 70 for warming of the latter. The additionally cooled gas is discharged from heat exchanger 62 into line 63 from which it is divided into a minor portion for isentropic expansion, which is passed into line 64, and a major refrigeration fluid portion, which is passed into line 40. The minor portion gas is isentropically expanded in expansion engine 65, which may suitably comprise an expansion turbine, and the expanded minor portion gas is joined with the first portion of the overhead gas recovered from the fractionation zone from line 67 to form the aforementioned recycle minor part gas in line 68. The recycle minor part gas is partially warmed in heat exchanger 69, passed in line 70 to heat exchanger 62 for further warming therein by heat exchange with the compressed and chilled remaining part gas and finally discharged into line 54. From line 54 the warmed recycle minor part gas is joined with the heat exchanged overhead gas second portion from line 53 for compression therewith in compressor 56.

The major refrigeration fluid portion in line 40 is divided into two parts. One part is passed by line 38 to fractionation zone reboil coil 90, wherein the one part is cooled for condensation thereof to form cooled liquid by heat exchange with fractionation zone bottoms liquid for vaporization of the latter to provide reboil vapor for the fractionation zone. The cooled liquid one part is then passed from reboil coil 90 through line 39 to heat exchanger 72 wherein the cooled liquid one part is subcooled by heat exchange with the recycle minor part gas entering from line 68 for the aforementioned warming of the latter. The other part of the major refrigeration fluid portion is diverted in line 41 and is throttled by throttle valve 42 therein to low pressure. The subcooled liquid one part withdrawn from heat exchanger 72 in line 73 is then joined with the throttled other part from line 41 to form a refrigeration gas-liquid mixture in line 74. The refrigeration gas-liquid mixture is throttled by throttle valve 75 to lower pressure and warmed in heat exchanger 76 to form a first gaseous fraction and a first liquid fraction therefrom by heat exchange with the recirculation portion of bottoms liquid recovered from the fractionation zone entering heat exchanger 76 in line 29. In this heat exchange, the fractionation zone bottoms liquid recirculation portion is subcooled, as discussed earlier herein.

The first gaseous fraction of the refrigeration gas-liquid mixture is separated in heat exchanger 76 from the first liquid fraction, with the first gaseous fraction being withdrawn therefrom in line 77 and the first liquid fraction being withdrawn therefrom in line 78. The separated first liquid fraction of the refrigeration gas-liquid mixture is then throttled by throttling valve 79 in line 78 to still lower pressure and warmed in heat exchanger 13 to form a second gaseous fraction and a second liquid fraction therefrom. This warming is effected in heat exchanger 13 by heat exchange with the feed gas mixture entering in line 12 as the final part of the aforementioned cooling thereof. The second gaseous fraction of the refrigeration gas-liquid mixture first liquid fraction is separated in heat exchanger 13 from the second liquid fraction thereof, with the second gaseous fraction being withdrawn in line 71 and the second liquid fraction being withdrawn therefrom in line 34. The second liquid fraction is then flowed through line 34, throttled by throttling valve 35 therein and introduced directly to the upper end 33 of fractionation zone 27 as reflux liquid therefor. In this manner the second liquid fraction is heat exchanged with fractionation zone overhead to provide reflux cooling for the fractionation zone. The second gaseous fraction in line 71 and the first gaseous fraction from line 77 are then joined with the recycle minor part gas in line 68.

The process shown in FIG. 1 is provided with separate control systems associated with the first absorption and fractionation zones to adjust the process facility to a turn down condition in which the flow rate of feed gas mixture to the process has been reduced. The control system associated with the first absorption zone includes flow rate sensor 80 which senses the flow rate of the feed gas mixture introduced to the first absorption zone in line 12. The flow rate sensing by element 80 is converted into a transmittable signal which is transmitted by signal line 81 to controller 82 which in turn is coupled via control signal transmission line 83 to a suitable valve actuator, which may for example be of conventional electrical or electropneumatic type, for the flow control valve 84 in methane wash liquid recirculation line 85. In operation the flow rate of the methane wash liquid recirculated to the absorption zone is adjusted by means of the control signal to maintain a predetermined ratio of the flow rate of the recirculated methane wash liquid to the flow rate of the feed gas mixture introduced to the first absorption zone. In this manner the adjustment in flow rates of the streams introduced to the first absorption zone is reflected in the second absorption zone where reduced amounts of throttled bottoms liquid from the first absorption zone and hydrogen rich vapor are introduced.

In the fractionation zone control system, temperature of the fractionation zone at a point in its lower section is sensed by thermal probe 43 which relays the temperature sensing to controller 44. The controller in turn converts the temperature sensing into a transmittable signal which is transmitted by signal line 46 to valve actuator 47. Valve actuator 47 then opens or closes valve 42 in line 41 to a greater or lesser extent for adjustment of the fraction of the major refrigeration fluid portion which is divided as the other part thereof by means of the transmittable signal to maintain a predetermined temperature in the fractionation zone lower section. The flow control valve 42 adjusts to provide an increased bypass rate as signalled by temperature controller 44, thereby reducing the boil-up in the fractionation zone in response to reduced feed gas mixture flow rate conditions and maintaining a proper fractionation zone bottoms temperature.

Figure 2:
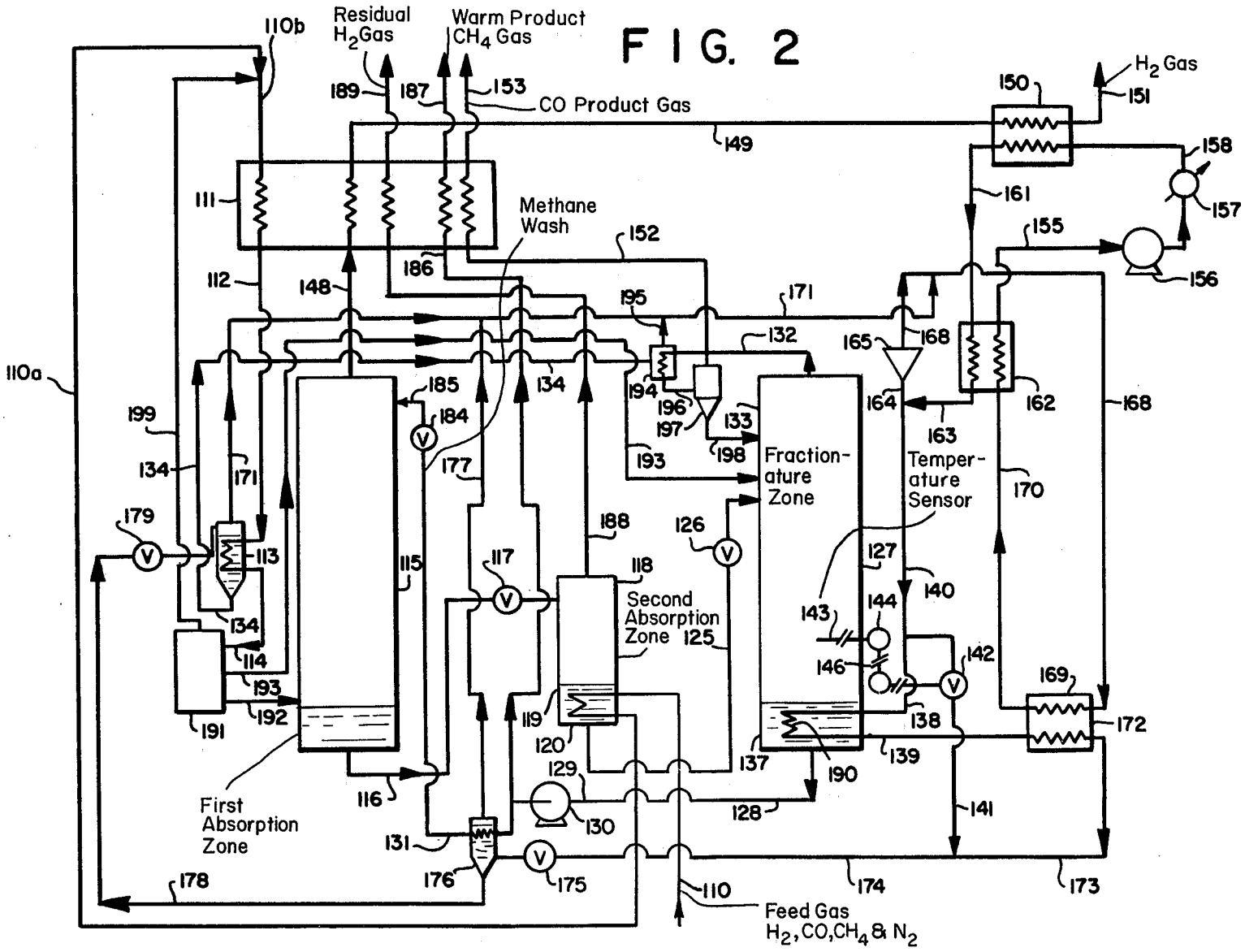
FIG. 2 is a schematic flowsheet of another embodiment of the invention in which externally supplied refrigeration fluid is circulated in a closed-loop refrigeration circuit to provide refrigeration for the process.

FIG. 2 represents another embodiment of the invention in which externally supplied refrigeration fluid is recirculated in a closed loop refrigeration circuit to provide refrigeration for the process. This embodiment avoids the extended circulation of carbon monoxide overhead gas recovered from the fractionation zone as process refrigeration fluid, as in the FIG. 1 system, which may be desirable in some instances due to the toxic character of carbon monoxide. The FIG. 2 flowsheet has been numbered correspondingly with respect to FIG. 1, by addition of 100 to the FIG. 1 reference numerals for the corresponding system elements in the FIG. 2 system.

The FIG. 2 process system differs from the process shown in FIG. 1 in that the feed gas mixture entering in line 110 is first cooled in the reboiler coil 122 disposed in the lower section of second absorption zone 119 and then passed by lines **110*a* and 110*b* to first heat exchanger 111. In this arrangement, the cooled feed gas withdrawn from the second heat exchanger 113 in line 114 is further cooled in the cooling complex 191 to yield a further cooled feed gas mixture which is passed to the first absorption zone in line 192, a recycle part of the feed gas mixture which is recirculated in line 199 to the feed gas mixture introduction line 110 upstream of first heat exchanger 111 and a substantially pure carbon monoxide stream which is passed to the fractionation zone 127 in line 193. The cooling complex 191 will be described in greater detail hereinbelow. Thus, in the arrangement of FIG. 2, the fractionation zone bottoms liquid recovered in line 128 flows directly to pump 130**. In this manner, the feed gas mixture is employed as the source of heat for vaporization warming of the second absorption zone bottoms liquid. In like manner, the heat energy associated with the feed gas mixture can alternatively be directed to supplying boil-up in the fractionation zone. In either case, the refrigeration load of the overall process is unaffected since the process heat requirement has been provided by heat exchange with intra-process streams.

Referring to the refrigeration circuit for the FIG. 2 embodiment, the externally supplied refrigeration fluid flowing as gas in line 155 is compressed in compressor 156 and discharged to line 158 wherein the compressed refrigeration fluid is chilled in water chiller 157. The compressed and chilled refrigeration fluid is partially cooled in heat exchanger 150 by heat exchanger with hydrogen product gas flowed therethrough from line 149 for final warming of the latter. Partially cooled refrigerant fluid is discharged from heat exchanger 150 to line 161, additionally cooled in heat exchanger 162 and discharged into line 163 as cooled and compressed refrigeration fluid. From line 163, the refrigeration fluid is divided into a minor portion for isentropic expansion in line 164 and a major refrigeration fluid portion in line 140. The refrigeration fluid minor portion is isentropically expanded in expansion engine 165 and discharged into line 168. The discharged fluid in line 168 is joined with the recirculated regasified refrigerant fluid from line 171, warmed in heat exchanger 169, discharged into line 170, further warmed in heat exchanger 162, and passed in line 155 to the compressor 156 as the process refrigerant.

The major refrigeration fluid portion in line 140 is divided into two parts comprising one part in line 138 and the other part in line 141. The one part in line 138 is cooled for condensation thereof to form cooled liquid in reboil coil 190 by heat exchange with fractionation zone bottoms liquid in the lower end 137 of fractionation zone 127 for vaporization of the bottoms liquid to provide reboil vapor for the fractionation zone. The cooled liquid is discharged from reboil coil 190 to line 139 and passed therein to heat exchanger 172 wherein the cooled liquid one part is subcooled by heat exchange with the isentropically expanded refrigeration fluid minor portion entering from line 168 for the above-described warming of the latter. The other part of the second refrigerant portion gas in line 141 is throttled by throttle valve 142 and joined with the subcooled liquid one part discharged from heat exchanger 172 in line 173, to form a refrigeration gas-liquid mixture in line 174. The gas-liquid mixture is throttled by valve 175 in line 174 to lower pressure and passed to heat exchanger 176 for warming therein to form a first gaseous fraction and a first liquid fraction therefrom by heat exchange with a portion of the bottoms liquid recovered from the fractionation zone entering heat exchanger 176 in line 129. In the heat exchanger 176 the fractionation zone bottoms liquid recirculation portion is subcooled and discharged into line 131. In the heat exchanger the first gaseous fraction is separated from the first liquid fraction, with the first gaseous fraction being withdrawn in line 177 and the first liquid fraction being withdrawn in line 178. The separated first liquid fraction in line 178 is then throttled by throttling valve 179 to still lower pressure and passed to heat exchanger 113. In heat exchanger 113, the throttled liquid is warmed to form a second gaseous fraction and a second liquid fraction therefrom by heat exchange with the feed gas mixture flowed therethrough from line 112 as part of the feed gas cooling for the system. The second gaseous fraction is separated from the second liquid fraction in the heat exchanger 113, the second gaseous fraction being withdrawn therefrom in line 134. The separated second liquid fraction is passed in line 134 to the fractionation zone reflux condenser 194 and vaporized therein by heat exchange with fractionation zone overhead vapor withdrawn from fractionation zone 127 and passed to reflux condenser 194 in line 132. By this heat exchange the external refrigerant provides reflux cooling for the fractionation zone, as fractionation zone vapor is partially condensed to form a gas-liquid reflux mixture which is withdrawn from the condenser in line 196 and passed therein to the reflux phase separator 197. In the reflux phase separator, the cooled gas is separated from the condensed reflux liquid and discharged therefrom in line 152 as recovered overhead gas from the fractionation zone. This recovered overhead gas is then passed through heat exchanger 111 for warming thereof by heat exchange with the feed gas mixture entering heat exchanger 111 in line 110 for partial cooling thereof. The warmed recovered overhead gas is then discharged from the process system in line 153 as carbon monoxide product. Condensed liquid in phase separator 197 is returned to the fractionation zone in line 198 as reflux liquid therefor.

From heat exchanger 194, the vaporized second liquid fraction of the external refrigerant is withdrawn in line 195. The second gaseous fraction in line 171 is joined with the first gaseous fraction from line 177 and the vaporized second liquid fraction from line 195. The resulting combined stream in line 171 is then joined with the isentropically expanded refrigeration fluid minor portion.

The process embodiment shown in FIG. 2 also employs the fractionation zone temperature control system by which the quantity of heat transferred by the refrigeration fluid in the reboil coil 190 can be adjusted by manipulation of by-pass throttle valve 142 thereby providing a means of changing the boil-up rate and bottoms temperature of the fractionation zone and hence the composition of the overhead and under flow streams recovered therefrom. Such partial by-pass of the fractionation zone reboil coil provides an effective means of adjusting carbon monoxide product purity and can be used in conjunction with, or as a substitute for, the adjustment of second absorption zone operating pressure for such purpose.

The externally supplied refrigeration fluid for the FIG. 2 embodiment of the present invention most suitably comprises a refrigeration fluid which has a normal boiling point of less than about −178° C. Examples of such suitable refrigeration fluids include those comprising a substantially pure component selected from the group consisting of helium, argon, carbon monoxide, nitrogen, deuterium, air, oxygen and fluorine. Among the foregoing group of pure component fluids, nitrogen is particularly preferred in practice.

Figure 3:
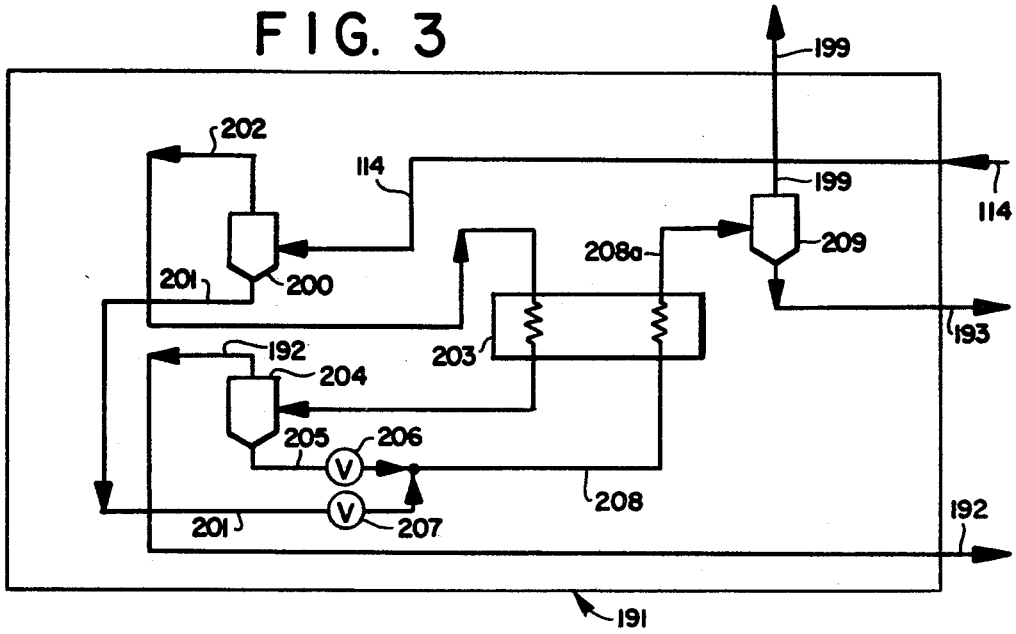
FIG. 3 is a schematic flowsheet of a cooling complex for partial cooling of the feed gas mixture in the FIG. 2 process.

FIG. 3 is a schematic flowsheet of the cooling complex 191 for partial cooling of the feed gas mixture in the FIG. 2 process system. In the FIG. 2 system, the feed gas mixture is first partially cooled in heat exchangers 122, 111 and 113 to condense a first feed liquid fraction therefrom. This partially condensed feed gas stream is withdrawn from heat exchanger 114 and passed into the cooling complex 191 shown in FIG. 3 to phase separator 200 therein. In the phase separator the first feed liquid fraction is separated from the uncondensed first partial cooled feed gas mixture, with the separated uncondensed first cooled feed gas mixture being withdrawn from separator 200 in line 202 and the first feed liquid fraction being withdrawn therefrom in line 201. The uncondensed first partial cooled feed gas mixture in line 202 is passed through heat exchanger 203 for second partial cooling thereof to condense a second feed liquid fraction therefrom and passed to phase separator 204. In phase separator 204 the second feed liquid fraction is separated from the uncondensed second partial cooled feed gas mixture. The latter is withdrawn from the separator in line 192 and passed to the first absorption zone as the cooled feed gas mixture therefor.

The separated second feed liquid fraction is withdrawn from phase separator 204 in line 205 and throttled by throttle valve 206 to the pressure level of the fractionation zone. The throttled second feed liquid fraction is then joined with the first feed liquid fraction, the latter also being throttled to the operating pressure level of the fractionation zone by throttle valve 207 in line 201. The resulting combined feed liquid formed in line 208 is then warmed for partial vaporization thereof in heat exchanger 203 by heat exchange with the uncondensed first partial cooled feed gas mixture entering heat exchanger 203 in line 202, for the second partial cooling of the latter.

The partially vaporized combined feed liquid is then passed in line **208*a* to phase separator 209 wherein the vapor portion thereof is separated from the liquid portion thereof. The separated vapor portion is withdrawn from the phase separator in line 199 and recycled to the inlet end of the process for joining with the introduced feed gas mixture in line 110. The separated liquid portion, comprising substantially pure carbon monoxide, is discharged from phase separator 209 in line 193** and passed to the fractionation zone for enhancement of the purity of carbon monoxide in the overhead gas recovered therefrom.

The cooling complex described is desirably employed when the feed gas mixture introduced to the separation process contains a high concentration of carbon monoxide, as for example at least 15 mol % carbon monoxide in the uncondensed first partial cooled feed gas mixture, i.e., the vapor phase of the feed gas mixture in line 114. The reason for the desirability of employing the above-described cooling complex under such feed gas conditions is that in the separation of feed with high carbon monoxide content, the temperature effects encountered in the absorption zone due to the heat of solution of carbon monoxide may be excessive, thereby causing an increase of the partial pressure of carbon monoxide and methane in the first absorption zone and the recovery of a hydrogen overhead product therefrom with relatively high carbon monoxide and methane content.

Due to the foregoing heat effects in the first absorption zone when the process is employed to process feed gas mixtures containing high concentrations of carbon monoxide, it may also be desirable when the feed gas mixture contains at least 30 mol % carbon monoxide to provide internal cooling in the first absorption zone, as for example by intercooling between the successive plates of a multi-plate column absorption zone wherein the liquid overflow from a plate is cooled before its introduction to the next lower plate. Internal cooling thus provides removal of the heat of solution of carbon monoxide in the methane was liquid, as generated in the contacting of the cooled feed gas mixture with the methane liquid therein.

In the process of this invention, the feed gas mixture is desirably cooled to a temperature at least −150° C (123° K). Such temperature constraint includes cooling effected by internal cooling of the feed gas mixture in the first absorption zone and is imposed to realize maximum separation efficiency in the absorption and fractionation zones so as to achieve high purity and high recovery levels for the recovered hydrogen and carbon monoxide product streams.

Figure 4:
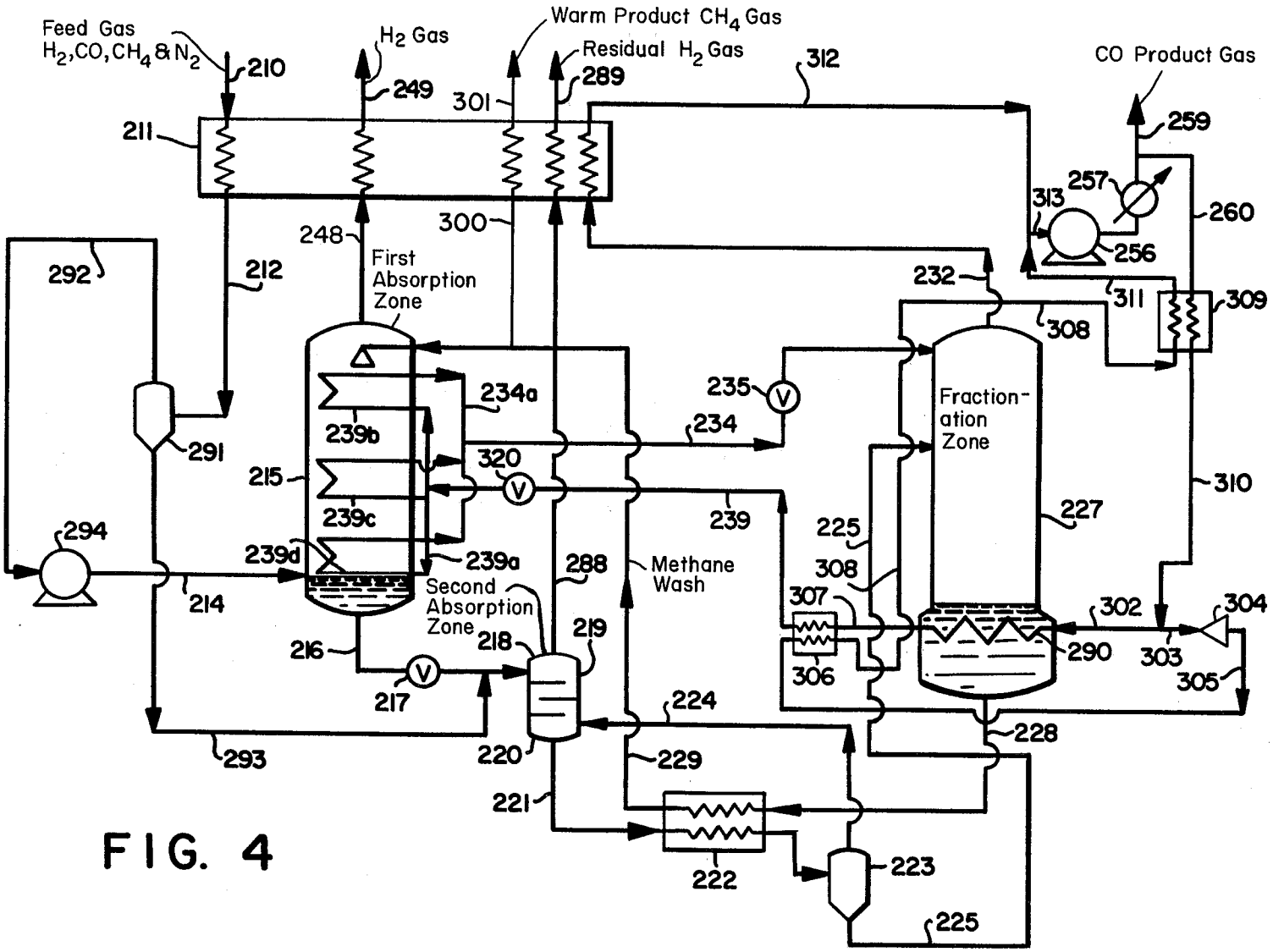
FIG. 4 is a schematic flowsheet of still another embodiment of the invention wherein the feed gas mixture is supplied at high pressure and work expanded for partial cooling thereof.

FIG. 4 shows an embodiment of the present invention utilizing internal refrigeration in the first absorption zone which is particularly suitable for separation of feed gas mixtures which are introduced into the process system at comparatively high pressure levels, as for example, at least 200 psia. In this embodiment, the feed gas mixture enters the process in line 210 and is partially cooled in heat exchanger 211 to condense a feed liquid fraction therefrom. The partially cooled and condensed feed gas mixture is passed from heat exchanger 211 in line 212 to phase separator 291. In the phase separator, the feed liquid fraction is separated from the uncondensed partial cooled feed gas mixture. The latter is withdrawn from the phase separator in line 292 and work expanded in expander 294 to lower pressure for cooling thereof as the final part of the cooling of the feed gas mixture, which is then passed to the first absorption zone 215 in line 214.

The separated feed liquid fraction is withdrawn from phase separator 291 in line 293 and joined with the bottoms liquid recovered from the absorption zone in line 216 which has been throttled by throttle valve 217 for introduction therewith to the upper section 218 of second absorption zone 219. Overhead hydrogen gas is recovered from the first absorption zone 215 in line 248, warmed against the feed gas mixture in heat exchanger 211 and discharged from the process system in line 249. In like manner the residual hydrogen gas recovered as overhead from the second absorption zone 219 in line 288 is warmed against the feed gas mixture in heat exchanger 211 and discharged from the process system in line 289.

From the second absorption zone 219, the bottoms liquid formed in the lower end 220 thereof is withdrawn in line 221 and partially vaporized in heat exchanger 222 to vaporize a gaseous fraction of the bottoms liquid containing hydrogen and carbon monoxide. It is to be noted that in the process of the present invention hydrogen is not stripped or depleted in the second absorption zone, but rather is removed in the vaporization warming step. The second absorption zone thus functions to remove carbon monoxide from the hydrogen rich vapor so that the vapor is depleted in carbon monoxide as the vapor ascends through the second absorption zone in the contacting step therein.

The gaseous fraction of the partially vaporized bottoms liquid from heat exchanger 222 is separated from the warmed bottoms liquid and recirculated to the second absorption zone in line 224 as the hydrogen rich vapor therefor. The warmed bottoms liquid is withdrawn in line 225 and is introduced to the fractionation zone 227. The bottoms liquid recovered from the fractionation zone in line 228 is cooled in heat exchanger 222 by passage in countercurrent flow heat exchange relationship with the bottoms liquid withdrawn from the second absorption zone, and a portion of the liquid thereafter is recirculated to the absorption zone in line 229 as the methane wash liquid therefor. The remaining part of the liquid is diverted in line 300, warmed and vaporized in heat exchanger 211 and discharged as product methane gas in line 301.

The overhead gas comprising carbon monoxide recovered from the fractionation zone in line 232 is warmed in heat exchanger 211, flowed through line 312 and joined with the recycle stream in line 311 to provide the combined stream in line 313. The combined stream is compressed in compressor 256 and chilled in water chiller 257. A portion of the compressed and chilled gas is withdrawn as carbon monoxide product in line 259, and the remainder is passed in line 260 to heat exchanger 309 for cooling therein and discharged to line 310. From line 310, compressed and cooled gas is divided into a minor portion for isentropic expansion in line 303 and a major refrigeration fluid portion in line 302. The minor portion is isentropically expanded in turbine 304 and discharged to line 305, warmed in heat exchanger 306, flowed through line 308 to heat exchanger 309 for further warming therein, and finally passed in line 311 to compressor inlet line 313. The major refrigeration fluid portion in line 302 is passed to the fractionation zone reboil coil 290. In the reboil coil the carbon monoxide refrigeration stream is cooled and condensed, and the resulting refrigeration liquid is flowed in line 307 to heat exchanger 306 for cooling therein and from heat exchanger 306 is passed in line 239 to the inlet cooling manifold **239*a* for the absorption zone 215, being throttled in line 239 by throttling valve 320. From the inlet cooling manifold, the carbon monoxide refrigeration fluid is passed through the cooling coils 239*b*, 239*c* and 239 disposed in the absorption zone, to provide internal cooling therefor, and is returned to the outlet cooling manifold 234a. From the outlet cooling manifold, the warmed carbon monoxide liquid is passed through line 234, throttled by throttling valve 235 therein and introduced to the fractionation zone 227** at the upper end thereof as reflux liquid to provide reflux cooling for the fractionation zone.

Figure 5:
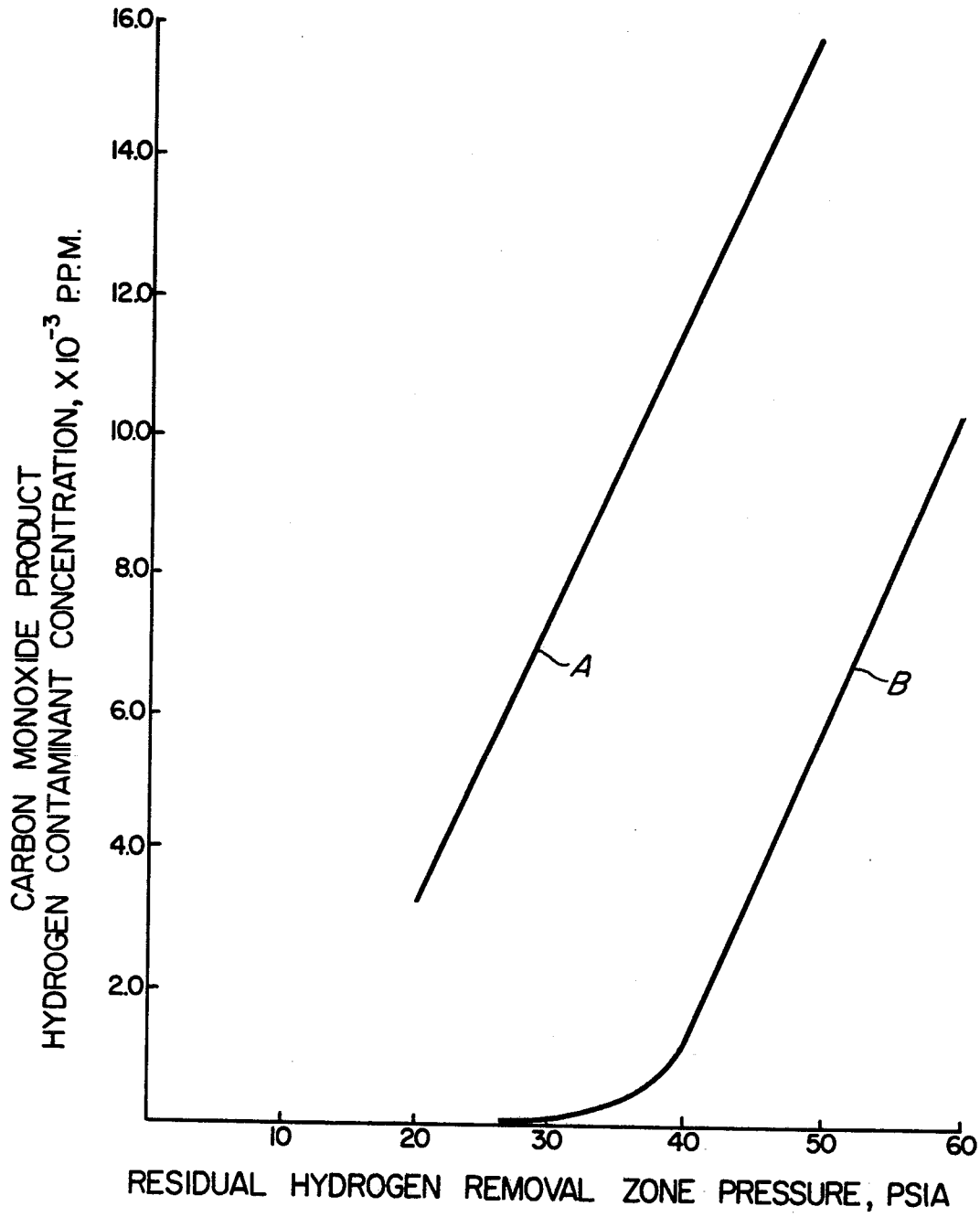
FIG. 5 is a graph of hydrogen contaminant concentration in the carbon monoxide product plotted against pressure in the residual hydrogen removal zone interposed between the absorption and fractionation zones, for a prior art process employing an equilibrium flash separation as the interposed zone and for a process according to the present invention.

FIG. 5 is a graph of hydrogen contaminant concentration in the carbon monoxide product plotted against operating pressure of the residual hydrogen removal zone interposed between the absorption and fractionation zones, for a prior art process (curve A) employing an equilibrium flash separation as the interposed zone and for a process according to the present invention (curve B) wherein second absorption and countercurrent heat exchange partial vaporization steps are employed. The graph is based on the respective process systems operating with a fractionation zone overhead pressure of 20 psia, with a feed gas mixture pressure of 200 psia and a molar feed composition of 79.8% hydrogen, 15.8% carbon monoxide, 4.2% methane and 0.2% nitrogen. FIG. 5 shows that the process of this invention is capable of providing carbon monoxide product of substantially higher purity, i.e., smaller contaminant hydrogen concentrations than the prior art process. For the above described feed gas mixture the prior art process is only capable of delivering carbon monoxide with 3400 ppm hydrogen when the equilibrium liquid-vapor separator is operated at a minimum pressure of 20 psia, and at a residual hydrogen removal zone pressure of 30 psia, the prior art process delivers carbon monoxide product with approximately 7000 ppm hydrogen, whereas the process of this invention at the same operating pressure in the second absorption zone yields product containing only about 1000 p.p.m. hydrogen contaminant.

Figure 6:
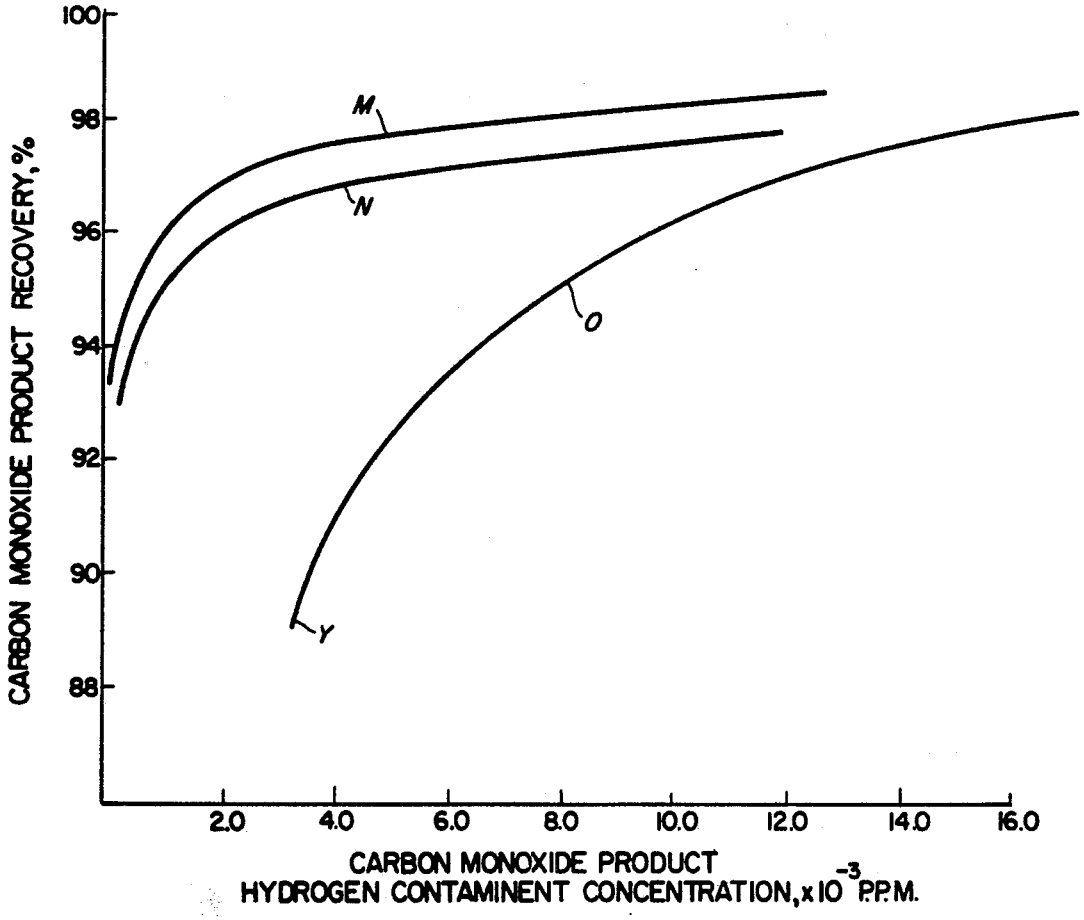
FIG. 6 is a graph of carbon monoxide product recovery plotted against hydrogen contaminant concentration in the carbon monoxide product, for a prior art process employing an equilibrium flash separation zone interposed between the absorption and fractionation zones and for a process according to the present invention.

FIG. 6 is a graph of carbon monoxide product recovery plotted against hydrogen contaminant concentration in the carbon monoxide product, for a prior art process employing an equilibrium flash separation zone interposed between the absorption and fractionation zone (curve O) and for a process according to the present invention (curves M and N). Curve M represents a process embodiment employing a second absorption zone comprising 3 theoretical equilibrium stages, and curve N represents a second absorption zone comprising 2 theoretical equilibrium stages. FIG. 6 shows that a significant improvement in recovery of carbon monoxide is obtained by the process of this invention relative to the prior art process, i.e., recoveries of greater than 96% at product purity levels of less than 2000 p.p.m. hydrogen contaminant are attainable in the practice of the present invention. By contrast, the recovery obtained with the prior art process deteriorates rapidly with product purities of less than 5000 p.p.m. hydrogen, with a recovery of only 89%, at the limiting equilibrium flash separation zone operating pressure condition of 20 psia, corresponding to point Y on Curve O.

Although preferred embodiments have been described in detail, it will be further appreciated that other embodiments are contemplated only with modification of the disclosure features, as being within the scope of the invention.

What is claimed is:

1. A process for the separation of a feed gas mixture containing hydrogen, carbon monoxide and methane comprising the steps of:

(a) cooling the feed gas mixture;

(b) countercurrently contacting the cooled feed gas mixture with a methane wash liquid in a first absorption zone to recover hydrogen gas as overhead and bottoms liquid comprising methane, carbon monoxide and residual hydrogen;

(c) throttling the bottoms liquid from the first absorption zone to lower pressure;

(d) countercurrently contacting the throttled bottoms liquid with hydrogen rich vapor in a second absorption zone for absorption of carbon monoxide from the hydrogen rich vapor by the throttled bottoms liquid therein to recover residual hydrogen gas as overhead and bottoms liquid enriched in carbon monoxide, and warming second absorption zone bottoms liquid to vaporize a gaseous fraction therefrom containing hydrogen and carbon monoxide, as said hydrogen rich vapor for said second absorption zone;

(e) fractionating the bottoms liquid recovered from said second absorption zone in a fractionation zone to recover overhead gas comprising carbon monoxide and bottoms liquid comprising methane; and (f) recirculating at least part of the bottoms liquid recovered from the fractionation zone to the first absorption zone as the methane wash liquid therefor.

2. A process according to claim 1 wherein the vaporization warming of said second absorption zone bottoms liquid is conducted internally in said second absorption zone by indirect heat exchange of said bottoms liquid with an in-process fluid stream.

3. A process according to claim 1 wherein bottoms liquid is withdrawn from the second absorption zone for said warming in step (d) to vaporize a gaseous fraction therefrom containing hydrogen and carbon monoxide, the vaporized gaseous fraction is separated from the warmed bottoms liquid and the vaporized gaseous fraction is passed to the second absorption zone as the hydrogen rich vapor therefor, with the warming being conducted so as to maintain a temperature gradient in the fluid being warmed, from the initial part of the warming to the final part thereof.

4. A process according to claim 3 wherein the bottoms liquid recovered from the fractionation zone is heat exchanged with the bottoms liquid withdrawn from the second absorption zone for the vaporization warming of the latter in step (d) and cooling of the fractionation zone bottoms liquid, the cooled fractionation zone bottoms liquid is pumped to higher pressure and a portion thereof is subcooled, with the sub-cooled portion being passed to the first absorption zone as the methane wash liquid therefor and the remaining portion of the cooled pumped fractionation zone bottoms liquid being warmed and vaporized by heat exchange with the feed gas mixture as at least part of the cooling of step (a) to form product methane gas.

5. A process according to claim 1 wherein the feed gas mixture contains 50 to 70 mol % hydrogen, 15 to 45 mol % carbon monoxide, and 2 to 6 mol % methane.

6. A process according to claim 1 wherein the second absorption zone comprises between two and five theoretical separation stages.

7. A process according to claim 1 wherein the residual hydrogen overhead gas recovered from the second absorption zone is warmed by heat exchange with the feed gas mixture as at least part of the cooling of step (a).

8. A process according to claim 1 wherein the overhead hydrogen gas recovered from the first absorption zone is warmed by heat exchange with the feed gas mixture as at least part of the cooling of step (a).

9. A process according to claim 8 wherein the overhead hydrogen gas warmed by heat exchange with the feed gas mixture is further warmed to about ambient temperature and withdrawn as product hydrogen gas.

10. A process according to claim 1 wherein a part of the carbon monoxide overhead gas recovered from the fractionation zone is warmed by heat exchange with the feed gas mixture as at least part of the cooling of step (a).

11. A process according to claim 1 wherein the feed gas mixture contains at least 30 mol % carbon monoxide and the first absorption zone is internally cooled for removal of the heat of solution of carbon monoxide in the methane wash liquid generated in the contacting of the cooled feed gas mixture with the methane liquid therein.

12. A process according to claim 1 comprising the further steps of: dividing the overhead gas recovered from the fractionation zone into two portions comprising a first portion and a second portion of the overhead gas recovered from the fractionation zone for warming thereof with the feed gas mixture as at least part of the cooling of the latter in step (a); compressing the heat exchanged overhead gas second portion to higher pressure and withdrawing a part thereof as carbon monoxide product gas; cooling the remaining part of the compressed overhead gas portion and dividing same into a minor portion for isentropic expansion and a major refrigeration fluid portion; isentropically expanding the minor portion and joining the isentropically expanded minor portion with the first portion of the overhead gas recovered from the fractionation zone to form a recycle minor part gas; warming the recycle minor part gas and joining same with the heat exchanged overhead gas second portion for compression therewith; dividing the major refrigeration fluid portion into two parts, cooling one part for condensation thereof to form cooled liquid by heat exchange with fractionation zone bottoms liquid for vaporization of the latter to provide reboil vapor for the fractionation zone, subcooling the cooled liquid one part by heat exchange with the recycle minor part gas for the warming of the latter, throttling the other part of the major refrigeration fluid portion to low pressure and joining the subcooled liquid one part with the throttled other part to form a refrigeration gas-liquid mixture; throttling the refrigeration gas-liquid mixture to lower pressure and warming same to form a first gaseous fraction and a first liquid fraction therefrom by heat exchange with a portion of the bottoms liquid recovered from the fractionation zone being recirculated to the first absorption zone as the methane wash liquid therefor, for subcooling of the latter; separating the first gaseous fraction of the refrigeration gas-liquid mixture from the first liquid fraction thereof; throttling the separated first liquid fraction of the refrigeration gas-liquid mixture to still lower pressure and warming same to form a second gaseous fraction and a second liquid fraction therefrom by heat exchange with the heat gas mixture as at least part of the cooling in step (a); separating the second gaseous fraction of the refrigeration gas-liquid mixture first liquid fraction from the second liquid fraction thereof; heat exchanging the separated second liquid fraction with fractionation zone overhead to provide reflux cooling for the fractionation zone; and joining the second gaseous fraction and the first gaseous fraction with the recycle minor part gas.

13. A process according to claim 12 wherein the feed gas mixture is heat exchanged with the bottoms liquid recovered from the fractionation zone for cooling of the latter prior to the subcooling of a portion thereof by heat exchange with the throttled lower pressure refrigeration gas-liquid mixture, as part of the cooling of the feed gas mixture in step (a).

14. A process according to claim 12 comprising the further steps of: sensing the temperature of the fractionation zone at a point in the lower section thereof; converting the fractionation zone temperature sensing into a transmittable signal; and adjusting the fraction of the major refrigeration fluid portion which is divided as the other part thereof by means of the transmittable signal to maintain a predetermined temperature in the fractionation zone lower section.

15. A process according to claim 1 wherein a portion of the overhead gas recovered from the fractionation zone is circulated in a refrigeration circuit to provide cooling of the bottoms liquid recovered from the fractionation zone recirculated to the first absorption zone as the methane wash liquid therefor, at least part of the cooling of the feed gas mixture in step (a) and reflux cooling for the fractionation zone.

16. A process according to claim 15 wherein overhead gas in the refrigeration circuit is heat exchanged with fractionation zone bottoms liquid for vaporization of the latter to provide reboil vapor for the fractionation zone and cooling of the heat exchanged overhead gas.

17. A process according to claim 1 wherein a portion of the overhead gas recovered from the fractionation zone is warmed by heat exchange with the feed gas mixture as at least part of the cooling of step (a), compressed to higher pressure and withdrawn as carbon monoxide product.

18. A process according to claim 1 wherein an externally supplied refrigeration fluid is circulated in a closed loop refrigeration circuit to provide refrigeration for the process, comprising the further steps of: compressing the refrigeration fluid, cooling the compressed refrigeration fluid and dividing same into a minor portion for isentropic expansion and a major refrigeration fluid portion; isentropically expanding the refrigeration fluid minor portion, warming the isentropically expanded refrigeration fluid minor portion and joining same with the refrigeration fluid for compression therewith; dividing the major refrigeration fluid portion of the compressed refrigeration fluid into two parts, cooling one part for condensation thereof to form cooled liquid by heat exchange with fractionation zone bottoms liquid for vaporization of the latter to provide reboil vapor for the fractionation zone, subcooling the cooled liquid one part by heat exchange with the isentropically expanded refrigeration fluid minor portion for the warming of the latter, throttling the other part of the major refrigeration fluid to low pressure and joining the subcooled liquid one part with the throttled other part to form a refrigeration gas-liquid mixture; throttling the refrigeration gas-liquid mixture to lower pressure and warming same to form a first gaseous fraction and a first liquid fraction therefrom by heat exchange with a portion of the bottoms liquid recovered from the fractionation zone being recirculated to the first absorption zone as the methane wash liquid therefor, for subcooling of the latter; separating the first gaseous fraction of the refrigeration gas-liquid mixture from the first liquid fraction thereof; throttling the separated first liquid fraction of the refrigeration gas-liquid mixture to still lower pressure and warming same to form a second gaseous fraction and a second liquid fraction therefrom by heat exchange with the feed gas mixture as at least part of the cooling in step (a); separating the second gaseous fraction of the refrigeration gas-liquid mixture first liquid fraction from the second liquid fraction thereof; heat exchanging the separated second liquid fraction for vaporization thereof with fractionation zone overhead to provide reflux cooling for the fractionation zone; and joining the vaporized second liquid fraction, the second gaseous fraction and the first gaseous fraction with the isentropically expanded refrigeration fluid minor portion.

19. A process according to claim 18 wherein the refrigeration fluid has a normal boiling point of less about −178° C.

20. A process according to claim 18 wherein the externally supplied refrigeration fluid comprises a substantially pure component selected from the group consisting of helium, argon, carbon monoxide, nitrogen, deuterium, air, oxygen, and flourine.

21. A process according to claim 18 wherein the externally supplied refrigeration fluid is nitrogen.

22. A process for the separation of a feed gas mixture containing hydrogen, carbon monoxide and methane comprising the steps of:

(a) cooling the feed gas mixture;

(b) countercurrently contacting the cooled feed gas mixture with a methane wash liquid in a first absorption zone to recover hydrogen gas as overhead and bottoms liquid comprising methane, carbon monoxide and residual hydrogen;

(c) throttling the bottoms liquid from the first absorption zone to lower pressure;

(d) countercurrently contacting the throttled bottoms liquid with hydrogen rich vapor in a second absorption zone for absorption of carbon monoxide from the hydrogen rich vapor by the throttled bottoms liquid therein to recover residual hydrogen gas as overhead and bottoms liquid enriched in carbon monoxide;

(e) withdrawing bottoms liquid from the second absorption zone and warming same to vaporize a gaseous fraction therefrom containing hydrogen and carbon monoxide, separating the vaporized gaseous fraction from the warmed bottoms liquid, and passing the vaporized gaseous fraction to the second absorption zone as the hydrogen rich vapor therefor, the warming being conducted so as to maintain a temperature gradient in the fluid being warmed from the initial part of the warming to the final part thereof;

(f) fractionating the warmed bottoms liquid in a fractionation zone to recover overhead gas comprising carbon monoxide and bottoms liquid comprising methane; and (g) recirculating at least part of the bottoms liquid recovered from the fractionation zone to the first absorption zone as the methane wash liquid therefor.

23. A process according to claim 22 wherein the bottoms liquid recovered from the fractionation zone is passed in countercurrent flow heat exchange relationship with the bottoms liquid withdrawn from the second absorption zone in the vaporization warming of the latter in step (e).

24. A process for the separation of a feed gas mixture containing hydrogen, carbon monoxide and methane comprising the steps of:

(a) cooling the feed gas mixture;

(b) countercurrently contacting the cooled feed gas mixture with a methane wash liquid in a first absorption zone to recover hydrogen gas as overhead product and bottoms liquid comprising methane, carbon monoxide and residual hydrogen;

(c) throttling the bottoms liquid from the first absorption zone to lower pressure;

(d) countercurrently contacting the throttled bottoms liquid with hydrogen rich vapor in a second absorption zone for absorption of carbon monoxide from the hydrogen rich vapor by the throttled bottoms liquid therein to recover residual hydrogen gas as overhead and bottoms liquid enriched in carbon monoxide;

(e) withdrawing bottoms liquid from the second absorption zone and warming same to vaporize a gaseous fraction therefrom containing hydrogen and carbon monoxide, separating the vaporized gaseous fraction from the warmed bottoms liquid, and passing the vaporized gaseous fraction to the second absorption zone as the hydrogen rich vapor therefor, the warming being conducted so as to maintain a temperature gradient in the fluid being warmed from the initial part of the warming to the final part thereof;

(f) fractionating the warmed bottoms liquid in a fractionation zone to recover overhead gas comprising carbon monoxide and bottoms liquid comprising methane;

(g) heat exchanging the bottoms liquid recovered from the fractionation zone with the bottoms liquid recovered from the second absorption zone for the vaporization warming of the latter in step (e) and cooling of the fractionation zone bottoms liquid;

(h) pumping the cooled fractionation zone bottoms liquid to higher pressure and subcooling a portion of same, passing the subcooled portion to the first absorption zone as the methane wash liquid therefor and warming the remaining portion of the cooled pumped fractionation zone bottoms liquid for vaporization thereof by heat exchange with the feed gas mixture as at least part of the cooling of step (a);

(i) dividing the overhead gas recovered from the fractionation zone in step (f) into two portions comprising a first portion and a second portion;

(j) heat exchanging the second portion of the overhead gas recovered from the fractionation zone for warming thereof with the feed gas mixture as at least part of the cooling of the latter in step (a);

(k) comprsssing the heat exchanged overhead gas second portion to higher pressure and withdrawing a part thereof as carbon monoxide product gas;

(l) cooling the remaining part of the compressed overhead gas portion and dividing same into a minor portion for isentropic expansion and a major heat pumping fluid portion;

(m) isentropically expanding the minor portion and joining the isentropically expanded minor portion with the first portion of the overhead gas recovered from the fractionation zone in step (f) to form a recycle minor part gas;

(n) warming the recycle minor part gas and joining same with the heat exchanged overhead gas second portion from step (j) for compression therewith in step (k);

(o) dividing the major heat pumping fluid portion into two parts, cooling one part for condensation thereof to form cooled liquid by heat exchange with fractionation zone bottoms liquid for vaporization of the latter to provide reboil vapor for the fractionation zone, subcooling the cooled liquid one part by heat exchange with the recycle minor part gas for the warming of the latter in step (n), throttling the other part of the major heat pumping fluid portion to low pressure and joining the subcooled liquid one part with the throttled other part to form a heat pumping gas-liquid mixture;

(p) throttling the heat pumping gas-liquid mixture to lower pressure and warming same to form a first gaseous fraction and a first liquid fraction therefrom by heat exchange with a portion of the bottoms liquid recovered from the fractionation zone being recirculated to the first absorption zone as the methane wash liquid therefor, for the subcooling of the latter in step (h);

(q) separating the first gaseous fraction of the heat pumping gas-liquid mixture from the first liquid fraction thereof;

(r) throttling the separated first liquid fraction of the heat pumping gas-liquid mixture to still lower pressure and warming same to form a second gaseous fraction and a second liquid fraction therefrom by heat exchange with the feed gas mixture as at least part of the cooling in step (a);

(s) separating the second gaseous fraction of the heat pumping gas-liquid mixture first liquid fraction from the second liquid fraction thereof;

(t) heat exchanging the separated second liquid fraction with fractionation zone overhead to provide reflux cooling for the fractionation zone; and (u) joining the second gaseous fraction and the first gaseous fraction with the recycle minor part gas.

25. A process for the separation of a feed gas mixture containing hydrogen, carbon monoxide and methane comprising the steps of:

(a) cooling the feed gas mixture;

(b) countercurrently contacting the cooled feed gas mixture with a methane wash liquid in a first absorption zone to recover hydrogen gas as overhead and bottoms liquid comprising methane, carbon monoxide and residual hydrogen;

(c) throttling the bottoms liquid from the absorption zone to lower pressure;

(d) countercurrently contacting the throttled bottoms liquid with hydrogen rich vapor in a second absorption zone for absorption of carbon monoxide from the hydrogen rich vapor by the throttled bottoms liquid therein to recover residual hydrogen gas as overhead and bottoms liquid enriched in carbon monoxide, and warming second absorption zone bottoms liquid to vaporize a gaseous fraction therefrom containing hdrogen and carbon monoxide, as said hydrogen rich vapor for said second absorption zone;

(e) fractionating the bottoms liquid recovered from said second absorption zone in a fractionation zone to recover overhead gas comprising carbon monoxide and bottoms liquid comprising methane;

(f) recirculating at least part of the bottoms liquid recovered from the fractionation zone to the first absorption zone as the methane wash liquid therefor;

(g) sensing the flow rate of the feed gas mixture introduced to the first absorption zone;

(h) converting the feed gas flow rate sensing into a transmittable signal; and (i) adjusting the flow rate of the methane wash liquid recirculated to the first absorption zone by means of the transmittable signal to maintain a predetermined ratio of the flow rate of the recirculated methane wash liquid to the flow rate of the feed gas mixture introduced to the first absorption zone.

26. A process for the separation of a feed gas mixture containing hydrogen, carbon monoxide and methane comprising the steps of:

(a) first partial cooling the feed gas mixture to condense a first feed liquid fraction therefrom;

(b) separating the first feed liquid fraction from the uncondensed first partial cooled feed gas mixture;

(c) throttling the separated first feed liquid fraction to a lower pressure level;

(d) second partial cooling the uncondensed first partial cooled feed gas mixture to condense a second feed liquid fraction from the uncondensed second partial cooled feed gas mixture;

(e) throttling the separated second feed liquid fraction to said lower pressure level of step (c);

(f) joining the throttled second feed liquid fraction with the throttled first feed liquid fraction to form a combined feed liquid;

(g) warming the combined feed liquid for partial vaporization thereof by heat exchange with the uncondensed first partial cooled feed gas mixture for the second partial cooling of the latter;

(h) separating the vapor portion of the partially vaporized combined feed liquid from the liquid portion thereof;

(i) joining the separated vapor portion of step (h) with the feed gas mixture for said first partial cooling of the feed gas mixture in step (a);

(j) countercurrently contacting the uncondensed second partial cooled feed gas mixture of step (d) with a methane wash liquid in a first absorption zone to recover hydrogen gas as overhead and bottoms liquid comprising methane, carbon monoxide and residual hydrogen;

(k) throttling the bottoms liquid from the first absorption zone to lower pressure;

(l) countercurrently contacting the throttled bottoms liquid of step (k) with hydrogen rich vapor in a second absorption zone for absorption of carbon monoxide from the hydrogen rich vapor by the throttled bottoms liquid therein to recover residual hydrogen gas as overhead and bottoms liquid enriched in carbon monoxide, and warming second absorption zone bottoms liquid to vaporize a gaseous fraction thereof containing hydrogen and carbon monoxide, as said hydrogen rich vapor for said second absorption zone;

(m) fractionating the bottoms liquid recovered from said second adsorption zone in a fractionation zone to recover overhead gas comprising carbon monoxide and bottoms liquid comprising methane;

(n) passing the liquid portion separated from the partially vaporized combined feed liquid in step (h), comprising substantially pure carbon monoxide, to the fractionation zone in step (m) for enhancement of the purity of carbon monoxide in the overhead gas recovered therefrom; and (o) recirculating at least part of the bottoms liquid recovered from the fractionation zone to the first absorption zone as the methane wash liquid therefor.

27. A process according to claim 26 wherein the uncondensed first partial cooled feed gas mixture contains at least 15 mol % carbon monoxide.

28. A process for the separation of a feed gas mixture containing hydrogen, carbon monoxide and methane comprising the steps of:

(a) providing the feed gas mixture at a pressure of at least 200 psia;

(b) partial cooling the feed gas mixture to condense a feed liquid fraction therefrom;

(c) separating the feed liquid fraction from the uncondensed partial cooled feed gas mixture;

(d) work expanding the separated uncondensed partial cooled feed gas mixture to lower pressure to form cooled feed gas mixture;

(e) countercurrently contacting the cooled feed gas mixture with a methane wash liquid in a first absorption zone to recover hydrogen gas as overhead and bottoms liquid comprising methane, carbon monoxide and residual hydrogen;

(f) throttling the bottoms liquid from the first absorption zone to lower pressure;

(g) joining the separated feed liquid fraction of step (c) with the throttled first absorption zone bottoms liquid to form a liquid mixture;

(h) countercurrently contacting the liquid mixture of step (g) with hydrogen rich vapor in a second absorption zone for absorption of carbon monoxide from the hydrogen rich vapor by the liquid mixture therein to recover residual hydrogen gas as overhead and bottoms liquid enriched in carbon monoxide, and warming second absorption zone bottoms liquid to vaporize a gaseous fraction therefrom containing hydrogen and carbon monoxide, as said hydrogen rich vapor for said second absorption zone;

(i) fractionating the bottoms liquid recovered from said second absorption zone in a fractionation zone to recover overhead gas comprising carbon monoxide and bottoms liquid comprising methane; and (j) recirculating at least part of the bottoms liquid recovered from the fractionation zone to the first absorption zone as the methane wash liquid therefor.

* * * * *